US006092761A

United States Patent [19]

Mushaben

[11] Patent Number: 6,092,761

[45] Date of Patent: Jul. 25, 2000

[54] IN-LINE WEB SEPARATOR

[75] Inventor: Thomas G. Mushaben, Cincinnati, Ohio

[73] Assignee: Clopay Plastic Products Company, Inc., Cincinnati, Ohio

[21] Appl. No.: 09/124,442

[22] Filed: Jul. 29, 1998

[51] Int. Cl.[7] ..... B65H 23/32

[52] U.S. Cl. ..... 242/615.21; 242/615.1; 242/615.2

[58] Field of Search ..... 242/615.21, 615.1, 242/615.2, 615, 566

[56] References Cited

U.S. PATENT DOCUMENTS

| | | | |
|---|---|---|---|
| 2,714,571 | 8/1955 | Irion et al. | 154/139 |
| 3,058,868 | 10/1962 | Schroeder | 154/139 |
| 3,103,843 | 9/1963 | Schoenberger, Jr. | 83/107 |
| 3,463,377 | 8/1969 | Lucas | 242/615 |
| 3,622,422 | 11/1971 | Newman | 156/306 |
| 3,765,616 | 10/1973 | Hutzenlaub et al. | 242/615.2 |
| 3,786,975 | 1/1974 | Heymanns | 226/194 |
| 3,832,267 | 8/1974 | Liu | 161/116 |
| 4,153,664 | 5/1979 | Sabee | 264/289 |
| 4,376,147 | 3/1983 | Byrne et al. | 428/167 |
| 4,379,197 | 4/1983 | Cipriani et al. | 428/220 |
| 4,410,122 | 10/1983 | Frye et al. | 242/615.2 |
| 4,452,845 | 6/1984 | Lloyd et al. | 428/220 |
| 4,472,328 | 9/1984 | Sugimoto et al. | 264/41 |
| 4,517,714 | 5/1985 | Sneed et al. | 28/103 |
| 4,522,203 | 6/1985 | Mays | 128/132 |
| 4,582,871 | 4/1986 | Noro et al. | 524/413 |
| 4,596,738 | 6/1986 | Metcalfe et al. | 428/308.4 |
| 4,614,679 | 9/1986 | Farrington, Jr. et al. | 428/138 |
| 4,626,574 | 12/1986 | Cancio et al. | 525/240 |
| 4,669,646 | 6/1987 | Oinonen | 242/615.2 X |
| 4,692,368 | 9/1987 | Taylor et al. | 428/137 |
| 4,705,812 | 11/1987 | Ito et al. | 521/92 |
| 4,705,813 | 11/1987 | Ito et al. | 521/92 |
| 4,725,473 | 2/1988 | Van Gompel | 428/156 |
| 4,753,840 | 6/1988 | Van Gompel | 428/171 |
| 4,777,073 | 10/1988 | Sheth | 428/155 |
| 4,811,880 | 3/1989 | Farish et al. | 242/615.2 |
| 4,814,124 | 3/1989 | Aoyama et al. | 264/41 |
| 4,921,652 | 5/1990 | Tsuji et al. | 264/41 |
| 4,921,653 | 5/1990 | Aoyama et al. | 264/41 |
| 5,035,941 | 7/1991 | Blackburn | 428/286 |
| 5,202,173 | 4/1993 | Wu et al. | 428/131 |
| 5,409,761 | 4/1995 | Langley | 428/198 |

FOREIGN PATENT DOCUMENTS 141592 5/1985 European Pat. Off. .

OTHER PUBLICATIONS

Schwarz, Eckhard C. A., *New Fibrillated Flim Structures, Manufacture and Uses*, Pap. Synth. Conf. (TAPPI), 1976, pp. 33–39.

*Primary Examiner*—Donald P. Walsh
*Assistant Examiner*—Minh-Chau Pham
*Attorney, Agent, or Firm*—Wood, Herron & Evans, L.L.P.

[57] ABSTRACT

The present invention is directed to a method and apparatus for in-line separation of polymer film and non-woven to compensate for the increased width due to stretching in the cross-machine (CD) direction. Due to the stretching in the cross-machine direction, typically by interdigital rolling or tentering, the width of individual webs is increased. To compensate for the increase in width, the apparatus and method of the present invention is employed to provide for in-line separation of the narrow webs. The apparatus of the present invention may allow for simplicity in threading the device, due to the ability to automatically thread individual turning bars by moving the turning bars across the undeflected path of the web.

9 Claims, 2 Drawing Sheets

IN-LINE WEB SEPARATOR

FIELD OF THE INVENTION

The present invention relates to devices for laterally separating a group of narrow web sections from one another after they have been slit from a wide web. More particularly the present invention relates to in-line separation of a group of webs to compensate for the increase in width due to stretching cross-machine in the direction (CD).

BACKGROUND OF THE INVENTION

Methods of making microporous film products have been known for some time. For example, U.S. Pat. No. 3,832,267, to Liu, teaches the melt-embossing of a polyolefin film containing a dispersed amorphous polymer phase prior to stretching or orientation to improve gas and moisture vapor transmission of the film. According to the Liu '267 patent, a film of crystalline polypropylene having a dispersed amorphous polypropylene phase is embossed prior to biaxially drawing (stretching) to produce an oriented imperforate film having greater permeability. The dispersed amorphous phase serves to provide microvoids to enhance the permeability of the otherwise imperforate film to improve moisture vapor transmission (MVT). The embossed film is preferably embossed and drawn sequentially.

Many other patents and publications disclose the phenomenon of making microporous thermoplastic film products. For example, European patent 141,592 discloses the use of a polyolefin, particularly ethylene vinyl acetate (EVA) containing a dispersed polystyrene phase which, when stretched, produces a voided film which improves the moisture vapor permeability of the film. The EP '592 patent also discloses the sequential steps of embossing the EVA film with thick and thin areas followed by stretching to first provide a film having voids which, when further stretched, produces a net-like product. U.S. Pat. Nos. 4,596,738 and 4,452,845 also disclose stretched thermoplastic films where the dispersed phase may be a polyethylene filled with calcium carbonate to provide the microvoids upon stretching. Later U.S. Pat. Nos. 4,777,073; 4,921,653; and 4,814,124 disclose the same processes described by the above-mentioned earlier publications involving the steps of first embossing a polyolefin film containing a filler and then stretching that film to provide a microporous product.

U.S. Pat. Nos. 4,705,812 and 4,705,813 disclose microporous films have been- produced from a blend of linear low density polyethylene (LLDPE) and low density polyethylene (LDPE) with barium sulfate as the inorganic filler having an average particle diameter of 0.1–7 microns. It is also know to modify blends of LLDPE and LDPE with a thermoplastic rubber such as KRATON. Other patents such as U.S. Pat. No. 4,582,871 disclose the use of thermoplastic styrene block tripolymers in the production of microporous films with other incompatible polymers such as styrene. There are other general teachings in the art such as the disclosures in U.S. Pat. Nos. 4,921,652 and 4,472,328.

Relevant patents regarding extrusion lamination of unstretched non-woven webs include U.S. Pat. Nos. 2,714,571; 3,058,868; 4,522,203; 4,614,679; 4,692,368; 4,753,840 and 5,035,941. The above '863 and '368 patents disclose stretching extruded polymeric films prior to laminating with unstretched non-woven fibrous webs at pressure roller nips. The '203 and '941 patents are directed to co-extruding multiple polymeric films with unstretched non-woven webs at pressure roller nips. The '840 patent discloses preforming non-woven polymeric fiber materials prior to extrusion laminating with films to improve bonding between the non-woven fibers and films. More specifically, the '840 patent discloses conventional embossing techniques to form densified and undensified areas in non-woven base plies prior to extrusion lamination to improve bonding between non-woven fibrous webs and films due to the densified fiber areas. The '941 patent also teaches that unstretched non-woven webs that are extrusion laminated to single ply polymeric films are susceptible to pinholes caused by fibers extending generally vertically from the plane of the fiber substrate and, accordingly, this patent discloses using multiple co-extruded film plies to prevent pinhole problems. Furthermore, methods for bonding loose non-woven fibers to polymeric film are disclosed in U.S. Pat. Nos. 3,622,422; 4,379,197 and 4,725,473.

U.S. patent application Ser. No. 08/547,059 (herein incorporated by reference in its entirety), now abandoned, discloses a process and apparatus to continuously perform web splitting, separating, guiding and laminating steps in a single unit. A single wide web of a non-woven is slit into a number of narrow webs which are separated by the use of turning bars and steered into a laminator. More specifically, a web is unrolled from a wide roll of non-woven material. The incoming web is slit into narrow webs, the narrow webs move down line to turning bars which are displaced one from the other by a desired web separation distance. The spaced narrow webs are then guided into a nip of rollers for extrusion lamination with a polymer film. A molten polymer is extruded into the nip at a temperature above its softening point to form a polymeric film laminated to the narrow webs. The compressive force between the webs and the extrudate at the nip is controlled to bond one surface of the web to the film to form the laminate. The resulting laminate includes spaced strips of non-woven laminated to the polymer film with areas of nonlaminated film between the strips.

U.S. patent application Ser. No. 08/722,286 (herein incorporated by reference in its entirety), a Continuation-In-Part of the above referenced U.S. patent application Ser. No. 08/547,059, discloses a process and apparatus to continuously perform lamination of a polymer to another material where the polymer may have a different width than the material to which it is laminated. The Application is directed to a process and apparatus to continuously perform non-woven web splitting, folding, guiding and laminating steps in a single unit. Depending on the spacing between folded webs, each strip of polymer may include a loose flap on either side of the laminate area which may be suitable for forming a barrier cuff in a diaper or other hygiene product. The spacing between folded webs determines the width of the loose polymer flap which is formed. Again, the resulting laminate includes spaced strips of non-woven laminated to the polymer film with areas of nonlaminated film between the strips. These laminates having spaced strips of non-woven with areas of nonlaminated film therebetween are typically referred to as zone laminates.

SUMMARY OF THE INVENTION

The present invention is directed to a method and apparatus for in-line separation of webs, such as polymer film, non-woven and laminates thereof to compensate for the increased width due to stretching a group of webs in the cross-machine direction (CD). Due to the stretching in the cross-machine direction, typically by interdigital rolling, the width of a group of webs is increased. To compensate for the increase in width, the apparatus and method of the present invention is employed to provide for in-line separation of the narrow webs.

The in-line web separator of the present invention includes a web input and a web output. The input and output define a median line which is the undeflected web path. The web separator also includes a first plurality of web deflectors for deflecting the webs from the median line to a plurality of nonparallel separation directions, each of the deflectors typically includes an actuator for moving each deflector from an operable position to an inoperable position. When the deflectors are in the operable position a predetermined number of the first web deflectors are positioned one side of the median line and a predetermined number of the first web deflectors are positioned on an opposite side of the median line. The web separator also includes a second plurality of web deflectors for returning the plurality of webs to the median line. The in-line web separator of the present invention allows for self threading of the separator while a laminator line is in use. The self threading allows all process parameters to be controlled prior to spreading the webs which decreases down time for the laminator line.

These and other advantages and features, which characterize the invention, are set forth in the claims annexed hereto and forming a further part hereof. However, for a better understanding of the invention, and of the advantages and objectives attained through its use, reference should be made to the drawings, and to the accompanying descriptive matter, in which there is described exemplary embodiments of the invention.

DETAILED DESCRIPTION

Figure 1:
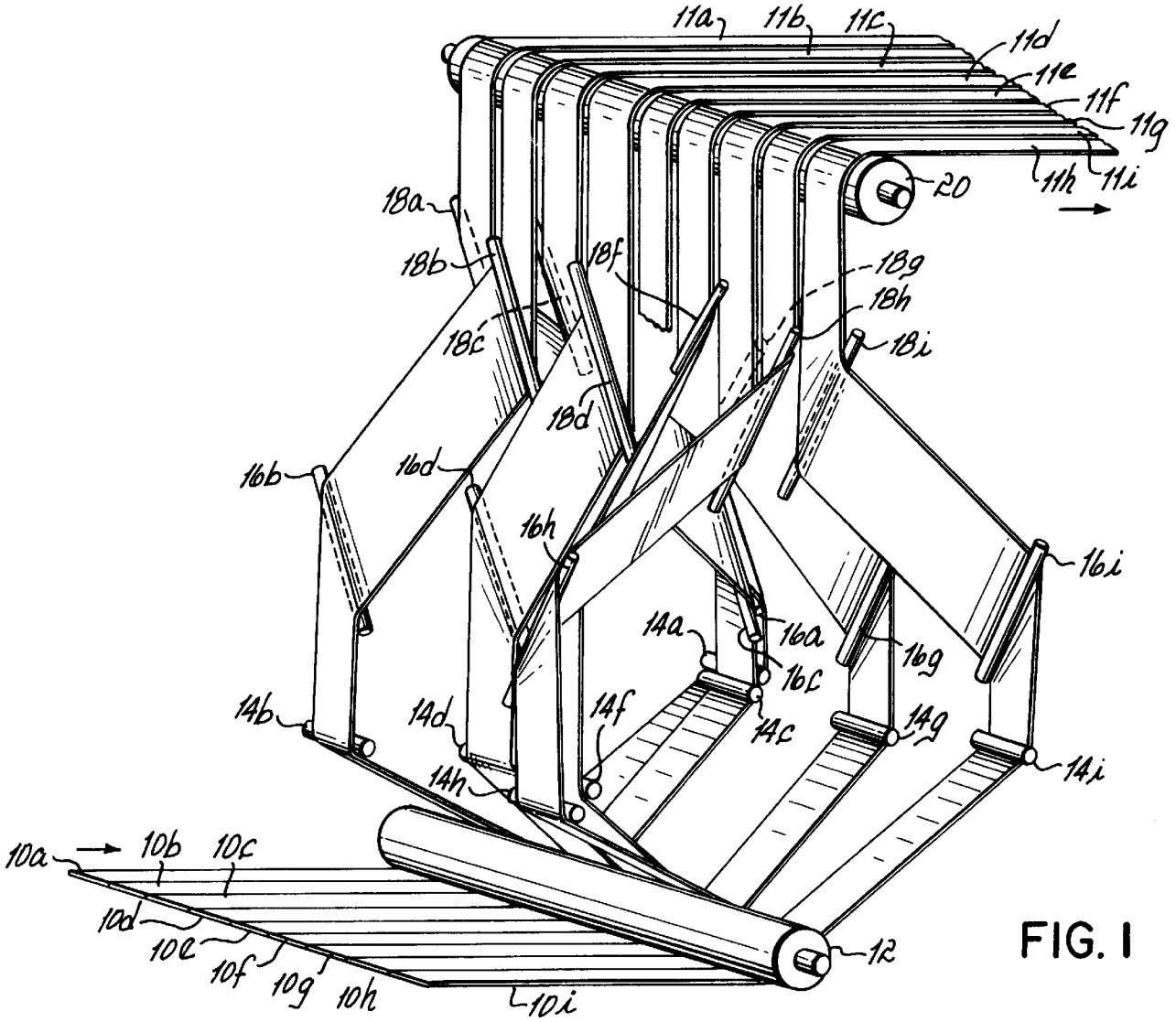
FIG. 1 is a schematic perspective view of the in-line web separator of the present invention.

In a preferred form, the present invention provides a method and apparatus for spacing a plurality of laminated strips of non-woven web material and polymer film on high speed production machinery. The laminate strips may then be expanded, typically by interdigital stretching. The films may be stretched such that they are impervious to the passage of fluid by virtue of the polymer film while allowing water vapor to pass through micropores and maintaining a soft feel on the fibrous web surface of the laminate. During the interdigital stretching the width of the laminate is increased, causing an overlap of adjacent strips of the laminate. The present invention provides a method and apparatus for separating a group of narrow webs of zone laminates either prior to or subsequent to cross-machine direction (CD) interdigital stretching to prevent the overlap.

In a preferred form, the laminate produced using the present invention has the desirable feature of microporosity to allow vapor transmission while preventing the passage of liquids as well as soft feel to achieve utility in a number of applications including diapers, underpads, sanitary napkins or other products. A useful laminate of this type is set forth in U.S. patent application Ser. No. 09/124,583 (Filed on even date herewith) entitled "METHOD AND APPARATUS FOR PIN-HOLE PREVENTION IN ZONE LAMINATES" (Inventor, Mushaben), incorporated herein in its entirety by reference.

As set forth in "METHOD AND APPARATUS FOR PIN-HOLE PREVENTION IN ZONE LAMINATES," the polymer film may be a thermoplastic polymer that is processable into a film for direct lamination by melt extrusion onto the non-woven web in one embodiment. The laminate of the present invention may be achieved with the use of a wide variety of polymer films; however, in a preferred form the film is manufactured by first melt blending a composition of: about 35% to about 45% by weight of a linear low density polyethylene, about 3% to about 10% by weight of a low density polyethylene, about 40% to about 50% by weight calcium carbonate filler particles, and about 2% to about 6% by weight of a triblock copolymer of styrene selected from the group consisting of styrene-butadiene-styrene, styrene-isoprene-styrene, and styrene-ethylene-butylene-styrene, and blends thereof. The composition is melt blended and then extruded into a nip of rollers to form a film at a speed on the order of at least about 550 fpm to about 1200 fpm without draw resonance, and applying an incremental strecting force to the film along lines substantially uniformly across the taut areas of the laminate and throughout its depth to provide a microporous film.

More particularly, in a preferred form, the melt-blended composition consists essentially of about 42% by weight LLDPE, about 4% by weight LDPE, about 44% by weight calcium carbonate filler particles having an average particle size of about 1 micron, and about 3% by weight triblock polymer, especially styrene-butadiene-styrene. If desired, the stiffness properties of the microporous film products may be controlled by including high density polyethylene on the order of about 0–5% by weight and including 0–4% by weight titanium dioxide. Typically, processing aid such as a fluorocarbon polymer in an amount of about 0.1% to about 0.2% by weight is added, as exemplified by 1-propene,1,1,2,3,3,3-hexafluoro copolymer with 1,1-difluoroethylene. The triblock polymer may also be blended with oil, hydrocarbon, antioxidant and stabilizer.

Both embossed and flat films may be produced according to the principles of this invention as set forth in the above referenced U.S. patent application Ser. No. 09/124,583. In the case of an embossed film, the nip of rollers comprises a metal embossing roller and a rubber roller. The compressive force between the rollers forms an embossed film of desired thickness on the order of about 0.5 to about 10 mils. It has also been found that rollers which provide a polished chrome surface form a flat film. Whether the film is an embossed film or a flat film, upon incremental stretching, at high speeds, microporous film products are produced having high MVTR within the acceptable range of about 1000 to 4000 $g/m^2$/day. It has been found that flat film can be incrementally stretched more uniformly than embossed film. The process may be conducted at ambient or room temperature or at elevated temperatures. As described above, laminates of the microporous film may be obtained with non-woven fibrous webs.

The non-woven fibrous web may comprise fibers of polyethylene, polypropylene, polyesters, rayon, cellulose, nylon, and bicomponent fibers of these polymers including sheath core, islands-in-the-sea or any other bicomponent fiber as well as blends of any of these fibers. A number of definitions have been proposed for non-woven fibrous webs. The fibers are usually staple fibers or continuous filaments. As used herein "non-woven fibrous web" is used in its generic sense to define a generally planar structure that is relatively flat, flexible and porous, and is composed of staple fibers or continuous filaments. For a detailed description of non-wovens, see "Nonwoven Fabric Primer and Reference Sampler" by E. A. Vaughn, Association of the Non-woven Fabrics Industry, 3d Edition (1992).

The microporous laminate typically employs a film having a gauge or a thickness between about 0.25 and 10 mils and, depending upon use, the film thickness will vary and, most preferably, in disposable applications is the order of about 0.25 to 2 mils in thickness. The non-woven fibrous webs of the laminated sheet normally have a weight of about 5 grams per square yard to 75 grams per square yard preferably about 20 to about 40 grams per square yard.

The laminate is then incrementally stretched in the cross machine direction (CD) or diagonally using the apparatus disclosed in "METHOD AND APPARATUS FOR PIN-HOLE PREVENTION IN ZONE LAMINATES" to form a stretched laminate having unstretched regions along the length of the laminate. The stretching in the CD direction expands the width of the laminate up to about 100% to 200% or more of the original laminate width.

In order to compensate for the increased width of the laminate the apparatus and process of the present invention has been developed to laterally separate individual strips from one another either before or after stretching. As shown in FIG. 1, the incoming webs 10*a*–10*i* have previously been slit from a wide web and subsequently stretched in the cross-machine direction (CD). In the arrangement shown in FIG. 2B, the outer edges of the incoming webs 10*a*–10*i* overlap one another due to the increase in width of the narrow webs during stretching in the cross-machine direction.

The central web 10*e* is taken around primary roller 12 and proceeds directly to a secondary roller 20. For clarity, the portion of the central web 10*e* is not shown between rollers 12 and 20. The outer incoming webs 10*a*–10*d* and 10*f*–10*i* are taken around primary roll 12 and then are deflected away from the central plane of web 10*e* by rollers 14*a*–14*d* and 14*f*–14*i*. The outer incoming webs 10*a*–10*d* and 10*f*–10*i* are then deflected away from the central web 10*e* by a first set of angled turning bars 16*a*–16*d* and 16*f*–16*i*. Due to this deflection the outer incoming webs 10*a*–10*d* and 10*f*–10*i* travel away from central web 10*e* until they reach a second set of angled turning bars 18*a*–18*d* and 18*f*–18*i* which turn the outer webs 10*a*–10*d* and 10*f*–10*i* so that they are parallel to central web 10*e*. The outgoing webs 11*a*–11*i* are then taken around secondary roller 20. Due to the deflection by the first set of turning bars 16*a*–16*i* and the second set of turning bars 18*a*–18*i*, the outgoing webs 11*a*–11*i* are parallel with a predetermined amount of space between the outer edge of the individual webs. The first set of turning bars 16*a*–16*i* is movable between an operable position and an inoperable position. When the first set of turning bars 16*a*–16*i* in its operable position, the incoming webs 10*a*–10*i* may be threaded directly from the input roller 12 to the secondary or output roller 20. The second set of turning bars 18*a*–18*i* may also be movable between an operable position and an operable position.

Typically, it is desired that the outer edges of the narrow webs 10*a*–10*i* abut one another; however, it is possible to control the distance between the webs by moving the rollers 14 and turning bars 16*a*–16*d* and 16*f*–16*i* either toward or away from the plane of central web 10*e*. By moving rollers 14 and turning bars 16 away from the central web 10*e*, the lateral spacing of outer webs 10*a*–10*d* and 10*f*–10*i* from the central web 10*e* is increased. Similarly, reducing the distance reduces the lateral separation of the outer webs 10*a*–10*d* and 10*f*–10*i* from the central web 10*e*.

Figure 2A:
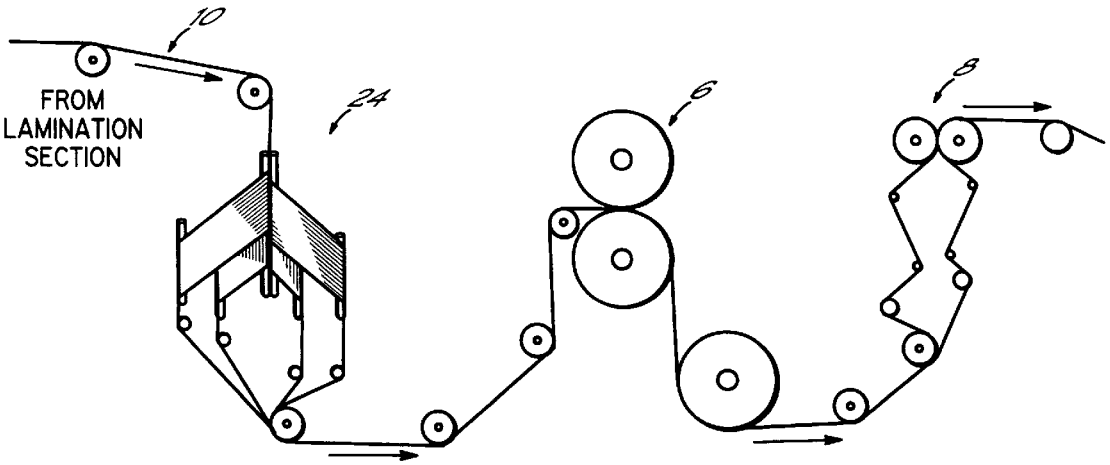
FIG. 2A is a schematic plan view showing one sequence of web separator, web stretcher and web spreader in which the present invention may be used.
Figure 2B:
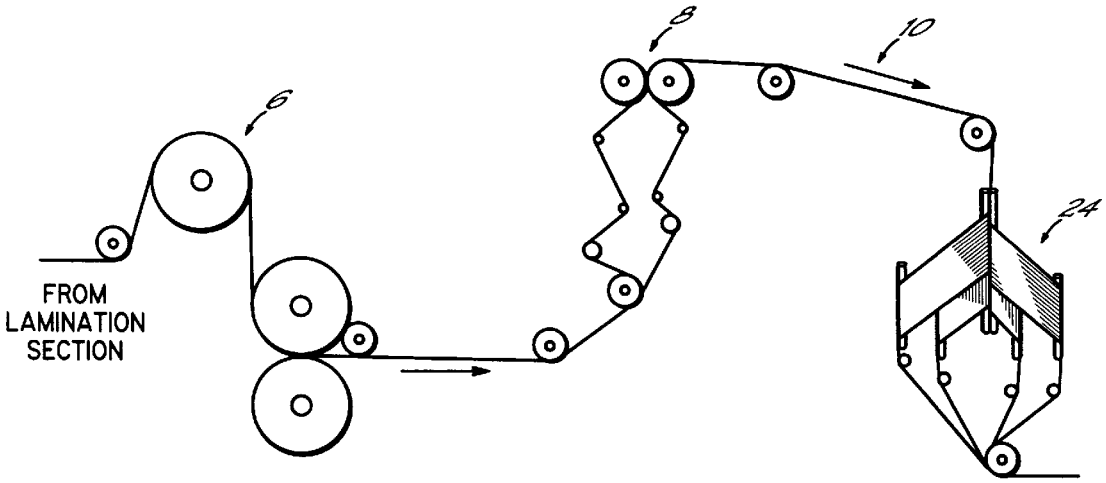
FIG. 2B is another schematic plan view showing one sequence of web stretcher, web spreader and web separator in which the present invention may be used.
Figure 2C:
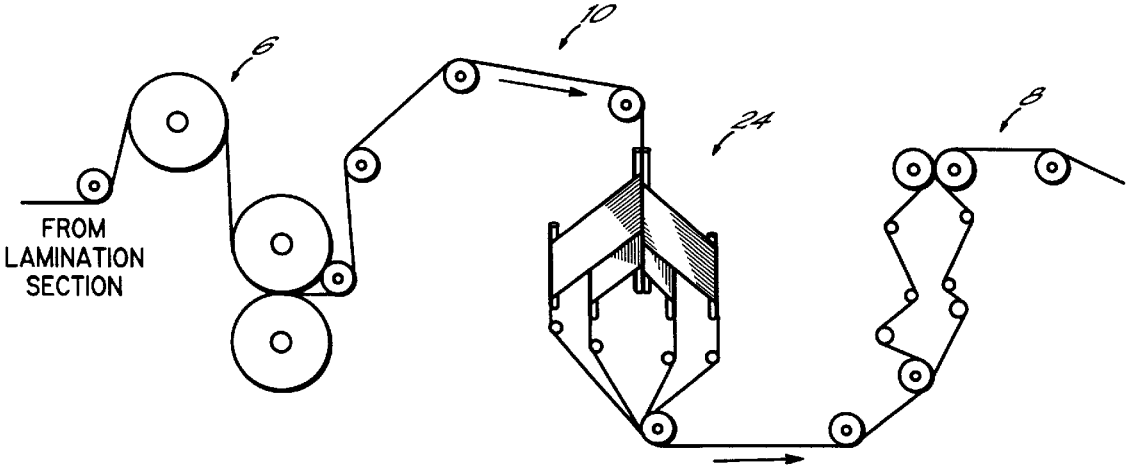
FIG. 2C is yet another schematic plan view showing one sequence of web stretcher, web separator and web spreader in which the present invention may be used.

As shown in FIGS. 2A, 2B and 2C it is possible to place the web stretcher 6, in-line web spreader 8 and web separator 24 in any sequence. Once the increase in width of incoming wide web 10 caused by stretching and spreading has been determined the in-line web separator 24 of the present invention may be placed in any position relative to the stretcher 6 and the spreader 8.

For example, as shown in FIGS. 2A and 2C, when the web separator 24 was to be placed up-stream from the stretcher 6 or the spreader 8, the rollers 14 and bars 16 would be positioned at distance from the central web 10*e* such that the lateral spacing of outer webs 10*a*–10*d* and 10*f*–10*i* from the central web 10*e* included a gap between the individual outgoing webs 11*a*–11*i*. FIGS. 2A–2C show three possible configurations for a stretching, spreading and separating line in which the in-line web separator 24 of the present invention is useful.

Those skilled in the art will recognize that the exemplary embodiment illustrated in the drawings is not intended to limit the invention. Indeed, those skilled in the art will recognize that other alternative embodiments may be used without departing from the scope of the invention.

What is claimed is:

1. An in-line web separator for laterally separating a plurality of incoming substantially parallel abutting, adjacent or overlapping webs, the web separator comprising:

an input station for receiving a plurality of incoming substantially parallel webs;

a first plurality of web deflectors for deflecting the plurality of substantially parallel webs discharged from the input station to a plurality of nonparallel separation directions such that the plurality of webs is no longer parallel, the first plurality of web deflectors being selectively movable between an inoperable position and an operable position;

a second plurality of web deflectors for deflecting the plurality of nonparallel webs such that the plurality of webs become substantially parallel and adjacent webs are laterally separated; and an output station for receiving the plurality of substantially parallel and laterally separated webs, the output station and the input station each having an axis defining a plane passing therebetween;

wherein in an inoperable position the first plurality of web deflectors is disposed on a first side of the plane such that the first plurality of web deflectors does not engage the plurality of substantially parallel webs in order that the plurality of substantially parallel webs may be threaded directly from the input station to the output station, in an operable position the first plurality of web deflectors is disposed on a second side on the plane such that the first plurality of web deflectors engage and thus deflect the plurality of substantially parallel webs.

2. The in-line web separator of claim 1, wherein said second plurality of web deflectors is disposed relative to the plane such that when the first plurality of web deflectors is in the inoperable position the second plurality of web deflectors does not engage the plurality of substantially parallel webs threaded between the input station and the output station.

3. The in-line web separator of claim 1, wherein said second plurality of web deflectors is selectively movable between an inoperable position and an operable position.

4. The in-line web separator of claim 1, further comprising:

a plurality of rollers intermediate the input station and the first plurality of web deflectors to guide the plurality of substantially parallel webs from the input station to the first plurality of web deflectors.

5. The in-line web separator of claim 1, wherein each web deflector is a turning bar.

6. The in-line web separator of claim 1, wherein at least one of the first plurality of web deflectors is on the first side of the plane and at least one of the first plurality of web deflectors is on the second side of the plane when the first plurality of web deflectors is in the inoperable position and the at least one web deflector from the first side moves to the second side and the at least one web deflector from the second side moves to the first side when the first plurality of web deflectors is in the operable position.

7. The in-line web separator of claim 1, wherein the input station and the output station are rollers.

8. The in-line web separator of claim 1, wherein the axes of the input station and the output station are parallel to one another, the input and output stations disposed transverse to a machine direction and each web deflector has an axis which is not parallel to the axes of the input station and the output station.

9. The in-line web separator of claim 8, wherein an angle is formed between the axis of individual web deflectors and the parallel axes of the input and output stations, the angle controlling the lateral separation between adjacent webs.

* * * * *

UNITED STATES PATENT AND TRADEMARK OFFICE

CERTIFICATE OF CORRECTION

PATENT NO. : 6,092,761
DATED : July 25, 2000
INVENTOR(S) : Thomas G. Mushaben

It is certified that error appears in the above-identified patent and that said Letters Patent is hereby corrected as shown below:

Column 1,
Line 46, "films have been produced" should be -- films produced --

Column 5,
Lines 14-15, "cross machine" should be -- cross-machine --
Line 59, "an operable position" should be -- an inoperable position --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*